US010076150B1

(12) United States Patent
Flatt

(10) Patent No.: US 10,076,150 B1
(45) Date of Patent: Sep. 18, 2018

(54) HAT WITH INTEGRATED SWEAT-GUIDING BAND

(71) Applicant: Erick P. Flatt, Dallas, TX (US)

(72) Inventor: Erick P. Flatt, Dallas, TX (US)

( * ) Notice: Subject to any disclaimer, the term of this patent is extended or adjusted under 35 U.S.C. 154(b) by 578 days.

(21) Appl. No.: 13/849,004

(22) Filed: Mar. 22, 2013

(51) Int. Cl.
*A42C 5/00* (2006.01)
*A42C 5/02* (2006.01)

(52) U.S. Cl.
CPC ..... *A42C 5/02* (2013.01)

(58) Field of Classification Search
CPC ..... A41D 20/00; A41D 20/005; A42C 5/02; Y10S 2/11
See application file for complete search history.

(56) References Cited

U.S. PATENT DOCUMENTS 2,027,471 A * 1/1936 Cason ..... A42C 5/02 2/181
2,445,209 A * 7/1948 Clark ..... A42C 5/02 2/181
5,926,849 A * 7/1999 Boyle ..... A42B 1/22 2/181.2
7,398,559 B2 * 7/2008 Flatt ..... A42C 5/02 2/174
2010/0132094 A1 * 6/2010 Mullen ..... A42C 5/02 2/410
2015/0143615 A1 * 5/2015 LePage ..... A41D 20/00 2/209.3

* cited by examiner

*Primary Examiner* — Anna Kinsaul

(57) ABSTRACT

An integrated sweat-guiding band and hat comprises a sweat-guiding band having a sweat-guiding portion and an adjustment portion wherein the sweat-guiding band further comprises a base wall and an upwardly extending containment wall defining a channel for conducting sweat away from a user's eyes, the sweat-guiding portion having a plurality of upwardly extending tabs. Adjustment straps are permanently attached to the sweat-guiding band, the adjustment straps including means for adjustably securing the sweat-guiding band to a user's head. A front panel of the hat is configured to couple front the front panel to the upwardly extending tabs to attach the cap/visor to the sweat-guiding band. The tabs are configured to be connected to the front panel in a manner that holds the front panel away from a user's forehead.

12 Claims, 8 Drawing Sheets hat 02 with integral sweat-guiding band hat 02 with integral sweat-guiding band hat 16 with integral sweat-guiding band sweat guide band with hat 25 sweat-guiding band with tabs 36 sweat-guiding band with tab connector sweat-guiding band and hat with sweat drain port sweat-guiding band with tab connector sweat guide with front wall connector sweat-guiding band with tab connector tab connector 66 suspension tab 68 sweat-guiding band with tab connector sweat-guiding band with tab connector sweat-guiding band with tab and spacer suspension tab connected
to tab connector method for assembling hat with sweat-guiding band

HAT WITH INTEGRATED SWEAT-GUIDING BAND

BACKGROUND

1. Technical Field

The present invention relates to hats and, more particularly, hats with built-in sweat-guiding bands.

2. Related Art

Hats have existed through out history for keeping the head warm in cold climates, for protecting the user from excessive heat and sun burn, for protection from the elements, work related hazards, sports related injuries, etc. One common problem, of course, is that people often sweat while wearing the hat. The perspiration from a forehead, for example, often soaks into the hat (e.g., baseball cap or visor) thereby staining the hat or flows into the user's eyes. Some people have responded to this problem by wearing absorbent sweatbands underneath the hat. The problem with sweatbands, however, is that they have a saturation point and eventually become ineffective in keeping sweat out of the eyes in addition to being cumbersome to wear along with a hat.

After a headband saturates, the user must remove the headband and replace it or excess perspiration will flow out from the saturated headband thereby rendering it ineffective. A prior need for a headband that prevents sweat from getting in one's eyes, even after a long period of time when conventional headbands would be saturated and dripping perspiration into one's eyes was addressed by the present inventor leading to U.S. Pat. Nos. 6,353,936 and 7,398,559. These patents are directed to sweat-guiding headbands that are non-absorbent and that guide sweat away from the user's forehead and eyes to a place where it can drain without interfering with the user's vision.

While these non-absorbent headbands have provided a great solution to an old problem, another problem continues to exist. Namely, these sweat bands do not provide relief from the sun, the elements, or protection from occupational and sporting hazards. As a result, people have been known to wear one of the non-absorbent sweatbands in addition to the hat of choice to enjoy the benefits of each.

SUMMARY OF THE INVENTION

The problems and needs outlined above are addressed by embodiments of the present invention. A hat with a permanently integrated sweat-guiding band operates to protect the user from the elements or external hazards (according to the type of hat) while also protecting the user's eyes from perspiration that accumulates on the forehead. The sweat-guiding band includes a substantially nonabsorbent band and a gutter structure that is operable to drain the sweat from the forehead to a drain point away from the user's eyes. The nonabsorbent sweat-guiding band includes a base wall that rests against the user's forehead, a channel for guiding sweat away from the forehead, an upwardly extending front wall that extends upward from the channel roughly parallel to the base wall to contain and drain the sweat and a plurality of tabs that extend upwardly from either one of the front wall and the base wall and that connect to the hat.

The hat contains and defines a front panel that is configured to engage with the tabs or tab connectors. In one embodiment, at least one reinforced member formed integral to the front panel defines at least one attachment point configured to connect to at least one of the plurality of tabs via a connector that either extends from the tab to the front panel or from the reinforced member in the front panel towards the tab. A pair of adjustment straps permanently attached to the hat and to the sweat-guiding band may be used to adjust the sweat-guiding band to fit the user's heat size and shape. The hat is configured to receive, at a bottom of the hat the sweat-guiding band and the pair of adjustment straps prior to the sweat-guiding band and the pair of adjustment straps being securely and permanently attached to the hat and when the front panel of the cap is attached to plurality of tabs, the sweat-guiding band is configured to cooperatively support the hat and hold the hat off of the user's forehead and further wherein the front panel is held in place away from the user's forehead by the sweat band guide to allow air to circulate between the user's forehead and the front panel.

BRIEF DESCRIPTION OF THE DRAWINGS

A better understanding of the present invention can be obtained when the following detailed description of the preferred embodiment is considered with the following drawings, in which.

DETAILED DESCRIPTION OF THE DRAWINGS

Figure 1:
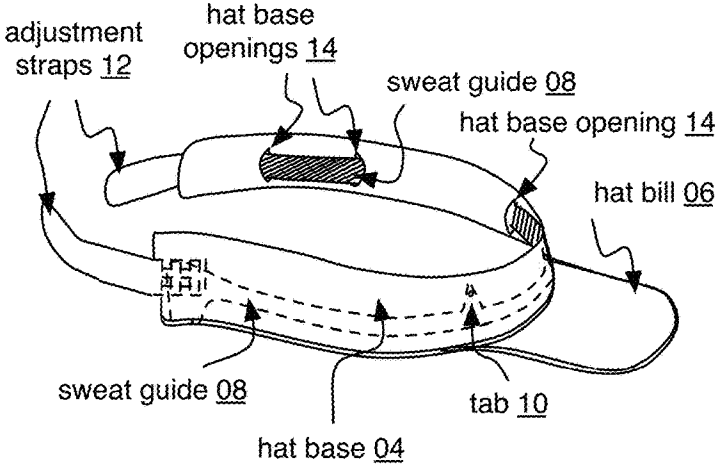
FIG. 1 is a visor with an integrated sweat-guiding band according to one embodiment of the invention.

FIG. 1 is a visor (hat) with an integrated sweat-guiding band according to one embodiment of the invention. The sweat-guiding band with hat 02 of FIG. 1 includes a visor base shown as hat base 04 and a bill shown as hat bill 06. While FIG. 1 specifically shows a visor, it should be understood that everything shown in FIG. 1 is equally applicable to caps and other types of hats. Accordingly, the term "hat" shall be used herein in reference to caps, visors and other types of hats. As may be further seen for the sweat-guiding band with hat 02 of FIG. 1, a sweat-guiding band 08 is shown in dashed lines since, in the embodiment of FIG. 1, the sweat-guiding band 08 is disposed within the hat base 04. Sweat-guiding band 08 includes a pair of tabs 10 that allow a front portion of sweat-guiding band 08 to be attached to a front panel of hat 02. As may also be seen, a pair of adjustment straps 12 are shown. Adjustment straps 12 include two straps, each of which is permanently attached to sweat-guiding band 08 and to hat base 04 of hat 02. The adjustment straps include any known means of coupling the straps to each other to adjustably hold the hat to the user's head. Such known means include buckling systems, tabbed connector systems, Velcro (trademark) and combinations of buckles and Velcro.

While shown more clearly in other figures, the adjustment straps 12, hat base 04, and sweat-guiding band 08 are all sewn together in one embodiment at an attachment point. Thus, the sweat-guiding band 08 is attached to hat 02 at the attachment point as well as to the front panel via tabs 10. As may further be seen, an inner surface of hat 02, and more particularly hat base 04, defines a plurality of hat base openings 14. These openings 14 support inserting the sweat-guiding band 08 and adjustments straps 12 into hat base 04 prior to being permanently attached to each other through stitching, sewing or other means. The inner surface of the hat is configured to selectively contact the user's head and when the sweat-guiding band 08 is inserted through the openings 14 in the hat 02, the inner surface is behind the sweat-guiding band 08 as shown in at least FIG. 1. While only two hat base openings 14 are shown, it should be understood that there are at least two more on an inside surface opposite the ones that are shown and that can't be seen in FIG. 1.

Figure 2:
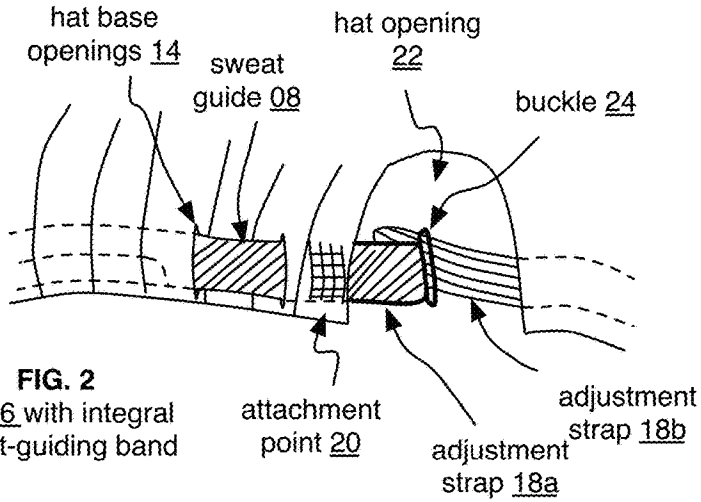
FIG. 2 is a sectional view of a hat to better illustrate attachment of a sweat-guiding band, adjustment straps and a hat base.

FIG. 2 is a sectional view of a hat to better illustrate attachment of a sweat-guiding band, adjustment straps and a hat base. Referring to FIG. 2, a hat 16 is permanently attached to sweat-guiding band 08 and to adjustment straps 18*a-b* at a pair of attachment points 20. Only one attachment point 20 is shown in FIG. 2 though it should be understood that there is one attachment point 20 for each of the two adjustment straps 18*a* and 18*b*. The attachment points 20 are disposed on opposite sides of hat opening 22. Generally, attachment points 20 are locations where, using any one of a plurality of known methods (sewing, stitching, buckling, buttoning, etc.), the hat 16, the sweat-guiding band 08 and the adjustment straps 12 are permanently attached to each other. Prior to the hat, the sweat-guiding band and the adjustment straps being attached to each other, the adjustment straps 18*a-b* and/or sweat-guiding band 08 are inserted through hat base openings 14 and the tabs 10 are connected to mating connectors (as will be described in greater detail below) to integrate the hat 16, the sweat-guiding band 08 and the adjustment straps 18*a-b* together.

While FIGS. 1 and 2 including hat base openings 14 that may be used to integrate a sweat-guiding band with a hat, other techniques for integrating a sweat-guiding band with a hat may readily be used. For example, the sweat-guiding band may be inserted between layers of material during construction of the hat prior to the hat being stitched together during fabrication.

Figure 3:
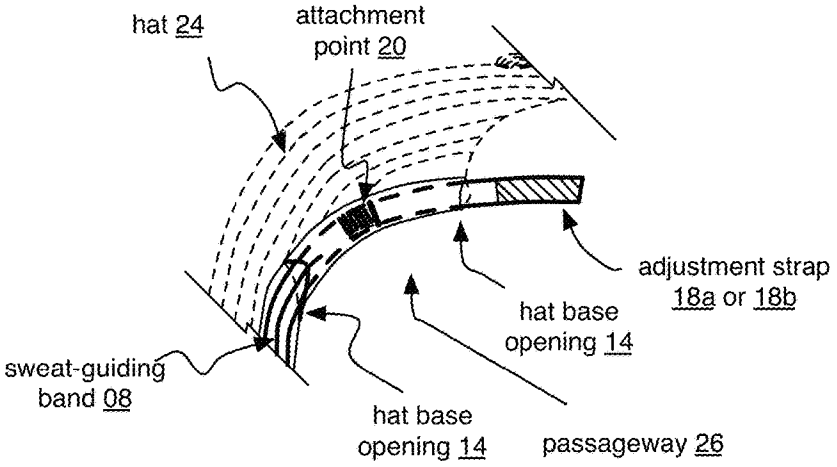
FIG. 3 is cutaway view of a hat that shows additional aspects of the various embodiments of the invention.

FIG. 3 is cutaway view of a hat that shows additional aspects of the various embodiments of the invention. A sweat-guiding band 08 with a hat 25 (e.g., cap, hat, visor, etc.) is shown in which a bottom rim or hat base defines a pair of passageways 26 through which the adjustment straps 18*a* or 18*b* or sweat-guiding band 08 may be inserted and threaded prior to being permanently attached at attachment point 20.

Figure 4:
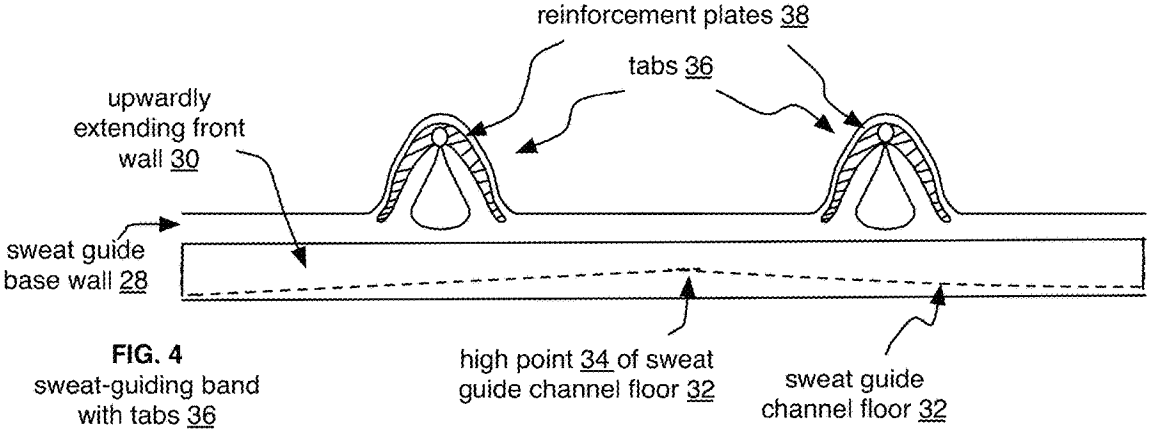
FIG. 4 is a sectional view of a sweat-guiding band according to one embodiment of the invention.

FIG. 4 is a sectional view of a sweat-guiding band according to one embodiment of the invention. Referring to FIG. 4, sweat-guiding band 08 includes a sweat-guiding base wall 28 and an upwardly extending front wall 30. Base wall 28 and front wall 30 form a channel (not shown here in FIG. 4). The channel has a channel floor 32 having a high point 34. Accordingly, channel floor 32 has a slope that slopes downward towards the back of sweat-guiding band 08. Sweat-guiding band 08 also includes a plurality of tabs 36 that are for coupling to a front panel of a hat. Each of the tabs 36 includes a reinforcement plate 38 that add structural rigidity to the tabs 36 to hold the front panel of the hat off of the sweat-guiding band to allow ventilation. Different structures for tabs and for coupling the tabs to the front panel of the hats will be shown and described in relation to some of the figures that follow.

Figure 5:
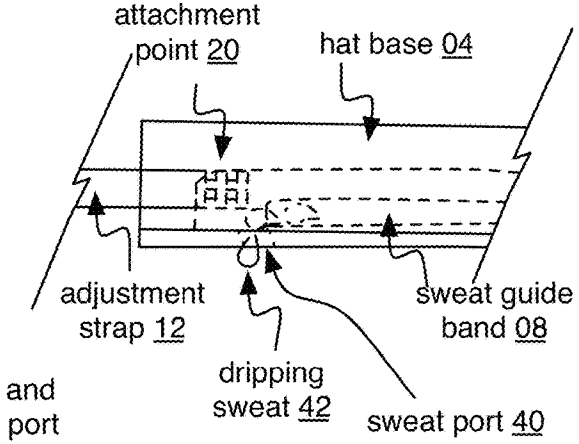
FIG. 5 is a cutaway view sweat-guiding band and hat with a sweat drain port according to one embodiment of the invention.

FIG. 5 is a cutaway view sweat-guiding band and hat with a sweat drain port according to one embodiment of the invention. Hat base 04 and sweat-guiding band 08 are shown. As may be seen by the dashed lines, sweat-guiding band 08 includes a base wall and a front wall. For example, these are similar to base wall 28 and a front wall 30 as described in relation to FIG. 4. Horizontally, base wall 28 extends past the end of front wall 30 (and channel floor 32. There, at the end of the front wall 30 and channel floor 32, hat base 04 defines a sweat drain port 40 to allow drops of sweat 42 to drain and drip from hat 02. As may further be seen, attachment 20 is disposed past the end of front wall 30. Thus, when sweat-guiding band 08 is attached to hat base 04 and adjustment straps 12 (or 18*a-b*), the attachment point does not interfere with sweat conduction along the channel floor of sweat-guiding band 08.

Figure 6:
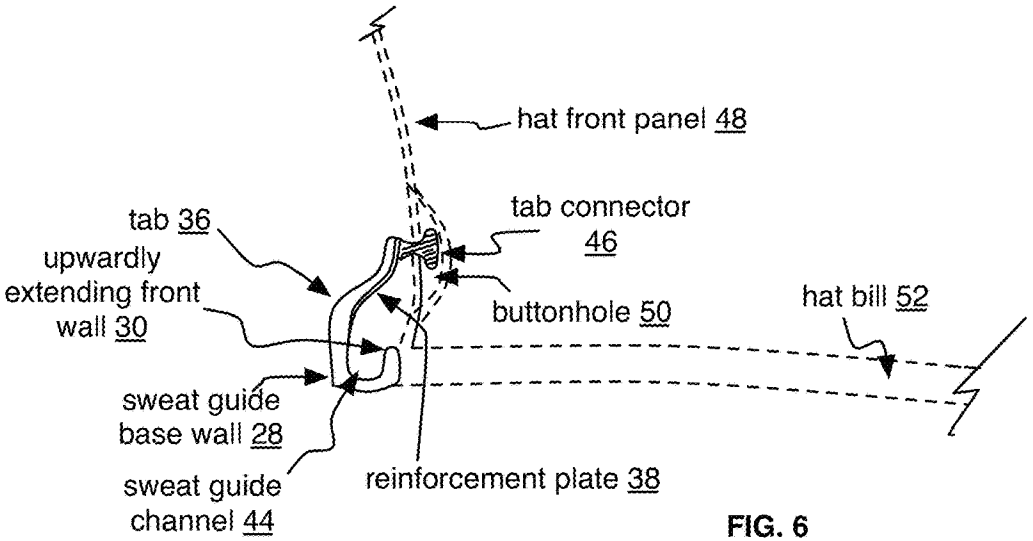
FIG. 6 is a side cut away view of the sweat-guiding band 08 with a tab and a tab connector in relation to a hat according to one embodiment of the invention.

FIG. 6 is a side cut away view of the sweat-guiding band 08 with a tab and a tab connector in relation to a hat according to one embodiment of the invention. As may be seen, the sweat-guiding band includes a base wall 28 and a front wall 30 as described before that jointly for a sweat-guiding channel 44 for conducting sweat. Base wall 28 includes a tab 36 that includes a reinforcement plate 38. As may be seen, tab 36 and reinforcement plate 38 have a curvilinear shape somewhat similar to an "S" shape in which a upper portion defines a surface that is approximately parallel to a lower portion surface (e.g., surface of base wall) though offset in relation to each other. Extending substantially horizontally from tab 36 is a tab connector 46. A hat front panel 48 defines a buttonhole 50 that is configured to receive and hold tab connector 46. As may be seen, the hat front panel 48, buttonhole 50 and tab connector 46 are all configured to cooperatively attach the hat front panel 48 such that a bottom surface of a hat bill 52 is substantially flush with a bottom surface of sweat-guiding channel 44.

It should be noted that the hat front panel of this embodiment includes a buttonhole 50 for receiving tab connector 50. Other designs may, alternatively, be used in which hat front panel 48 includes a matching piece that engages a tab or tab connector of the sweat-guiding band such as sweat-guiding band 08.

Figure 7:
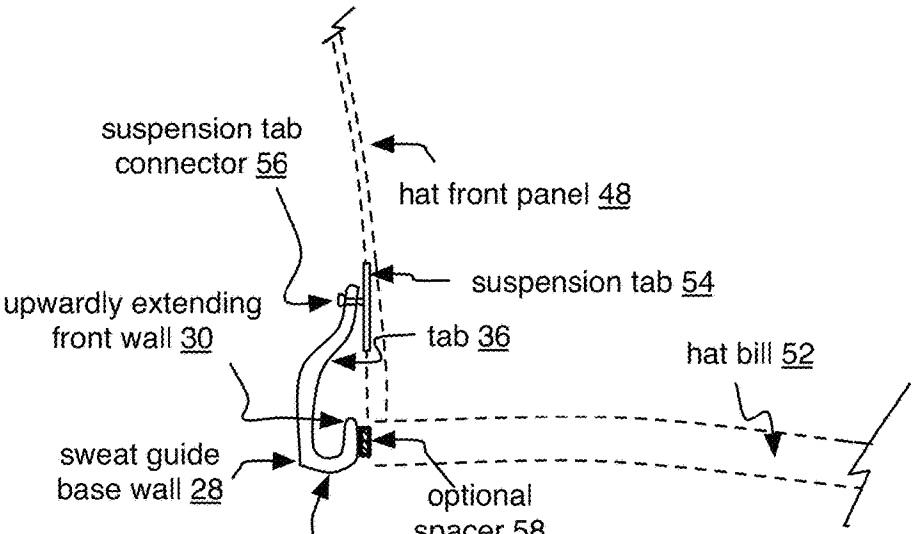
FIG. 7 is a side cut away view of the sweat-guiding band 08 with a tab and a tab connector in relation to a hat according to one embodiment of the invention.

FIG. 7 is a side cut away view of the sweat-guiding band 08 with a tab and a tab connector in relation to a hat according to one embodiment of the invention. As may be seen, the sweat-guiding band includes a base wall 28 and a front wall 30 as described before that jointly for a sweat-guiding channel 44 for conducting sweat. Base wall 28 includes a tab 36 that includes a reinforcement plate 38 (not shown here in FIG. 7). As may be seen, tab 36 has a curvilinear shape somewhat similar to an "S" shape in which a upper portion defines a surface that is approximately parallel to a lower portion surface (e.g., surface of base wall) though offset in relation to each other. The hat front panel 48 includes a suspension tab 54 that adds structural rigidity to hat front panel 48. Suspension tab 54 also provides a structural base to support a horizontally extending suspension tab connector 56 that that is configured to engage with an aperture formed with tab 36 of sweat-guiding band 08. As may be seen, the hat front panel 48, suspension tab 54 and suspension tab connector 56 are all configured to cooperatively attach the hat front panel 48 such that a bottom surface of a hat bill 52 is substantially flush with a bottom surface of sweat-guiding channel 44. Suspension tab 54 is integrally formed and secured with hat front panel 48 to hold suspension tab 54 in place. One of average skill in the art may readily choose and implement a structure and method for securely placing suspension tab 54 in fixed cooperation with hat front panel 48. Generally, suspension tab 54 comprises a flat plate like structure that provides shape to the hat front panel 48 and provides structure support for attaching to tab 36 and for holding the hat up and off of a user's forehead.

An additional aspect of the embodiment of the invention in FIG. 7 is the optional spacer 58 that is disposed (here) off of front wall 30 of the sweat-guiding band (e.g., sweat-guiding band 08). Using spacers 58 help hold the hat front panel 48 off of the user's forehead and off of the sweat-guiding band 08 to create ventilation (space in which air may be conductor to expel heat).

Figure 8:
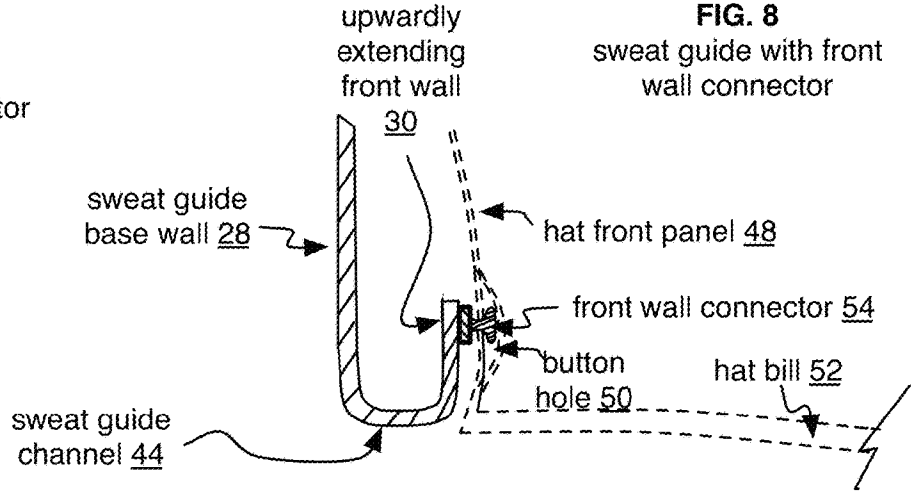
FIG. 8 is a cutaway view of an alternative embodiment of the invention in which a connector extends from a front wall of the sweat-guiding band to connect to the front panel of a hat.

FIG. 8 is a cutaway view of an alternative embodiment of the invention in which a connector extends from a front wall of the sweat-guiding band to connect to the front panel of a hat. Here, in FIG. 8, a front wall connector 56 extends substantially horizontally from a front wall 30 of an sweat-guiding band 08. In this embodiment, connector 54 connects to a buttonhole 50. Alternatively, however, connector 54 could also connect to a mating port on a suspension tab disposed within the hat front panel 48. As before, the buttonhole is configured such that the hat bill 52 is approximately flush with or even with a bottom surface of sweat-guiding channel 44.

Figure 9:
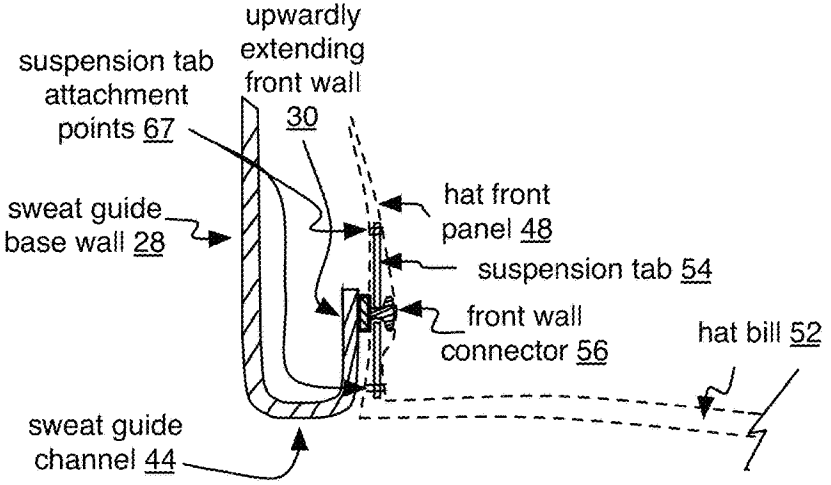
FIG. 9 is a cutaway view of an alternative embodiment of the invention in which a connector extends from a front wall of the sweat-guiding band to connect to the front panel of a hat.

FIG. 9 is a cutaway view of an alternative embodiment of the invention in which a connector extends from a front wall of the sweat-guiding band to connect to the front panel of a hat. Here, in FIG. 9, a front wall connector 56 extends substantially horizontally from a front wall 30 of an sweat-guiding band 08. In this embodiment, connector 56 connects to a suspension tab 54 disposed within the hat front panel 48. As before, the suspension tab 54 is configured such that the hat bill 52 is approximately flush with or even with a bottom surface of sweat-guiding channel 44 when front wall connector 56 is coupled to suspension tab 54. In the embodiment illustrated in FIG. 9, suspension tab 54 is disposed within layers of material of the hat front panel 48. Alternatively, suspension tab 54 may be disposed on an inner surface of hat front panel 48 so that it is not within the layers of material of hat front panel 48. As may also be seen, suspension tab 54 couples to hat front panel 48 via attachment points 67.

Figure 10:
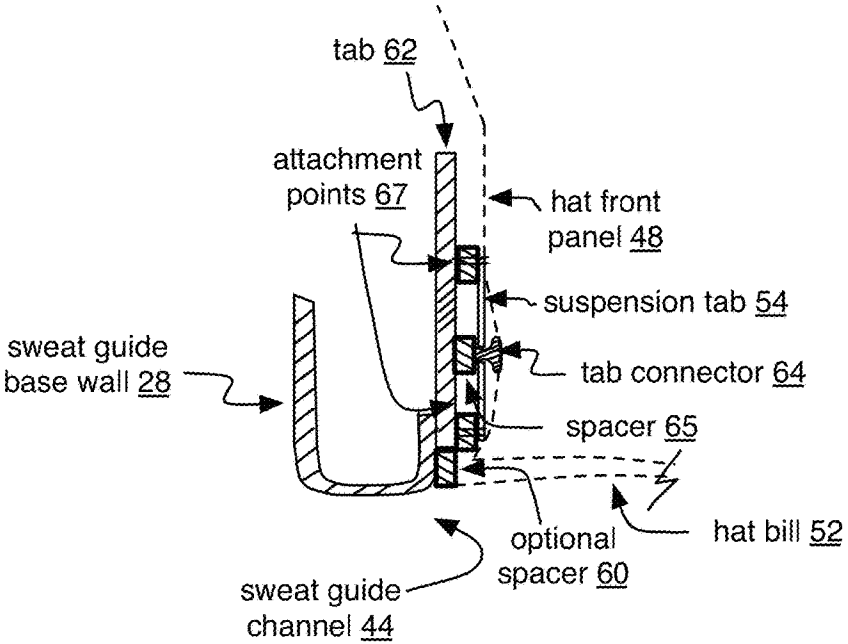
FIG. 10 is a cutaway view of an alternative embodiment of the invention in which a connector extends from a tab that extends upwards from a front wall of the sweat-guiding band to connect to the front panel of a hat.

FIG. 10 is a cutaway view of an alternative embodiment of the invention in which a connector extends from a tab that extends upwards from a front wall of the sweat-guiding band to connect to the front panel of a hat. Here, in FIG. 10, a front wall connector 56 extends substantially horizontally from a tab 62 that extends from front wall 30 of an sweat-guiding band 08. In this embodiment, tab connector 64 connects to a suspension tab 54 disposed within the hat front panel 48. As before, the suspension tab 54 is configured such that the hat bill 52 is approximately flush with or even with a bottom surface of sweat-guiding channel 44 when front wall connector 56 is coupled to suspension tab 54. One aspect of the embodiment of FIG. 10, however, is that an optional spacer 60 is attached to front wall 30 and tab 62 extends upward from spacer 60. A spacer 65 is disposed on a front surface of tab 62. A tab connector 64 then extends substantially horizontally from spacer 65 for coupling with a front panel of a hat. In this particular embodiment, connector 64 couples with a suspension tab 54. In one embodiment, tab 62 is similar to tabs 36 though other shapes and embodiments may readily be used to support a tab connector such as tab connector 64 that couples to a suspension tab 54. As may also be seen, suspension tab 54 couples to hat front panel 48 via attachment points 67.

Figure 11:
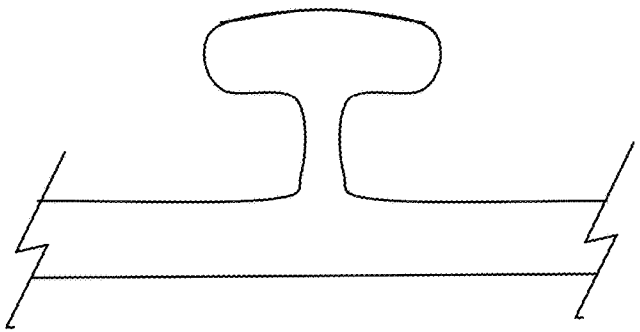
FIG. 11 is a front view of an alternative embodiment of a connector tab that can extend upwards from either a base wall or a front wall of a sweat-guiding band.

FIG. 11 is a front view of an alternative embodiment of a connector tab that can extend upwards from either a base wall or a front wall of a sweat-guiding band. Here, a tab connector 66 has a "T" shape and is configured to engage with a suspension tab as shown in FIG. 12.

Figure 12:
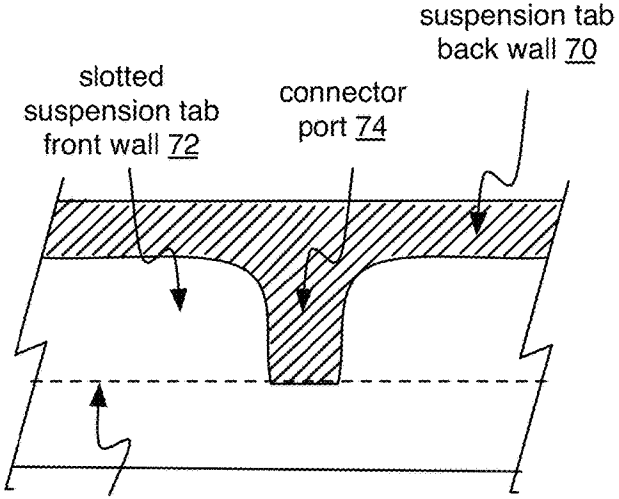
FIG. 12 is a front view of a suspension tab that is attached to and a part of a hat front panel.

FIG. 12 is a front view of a suspension tab that is attached to and a part of a hat front panel 48. As may be seen, suspension tab 68 includes a suspension tab back wall 70 and a slotted suspension tab front wall 72. The combination of the back wall 70 and the slotted front wall 72 form a connector port 74 for receiving and engaging tab connector 66. A support 76 forms a base that securely holds or supports tab connector 66.

Figure 13:
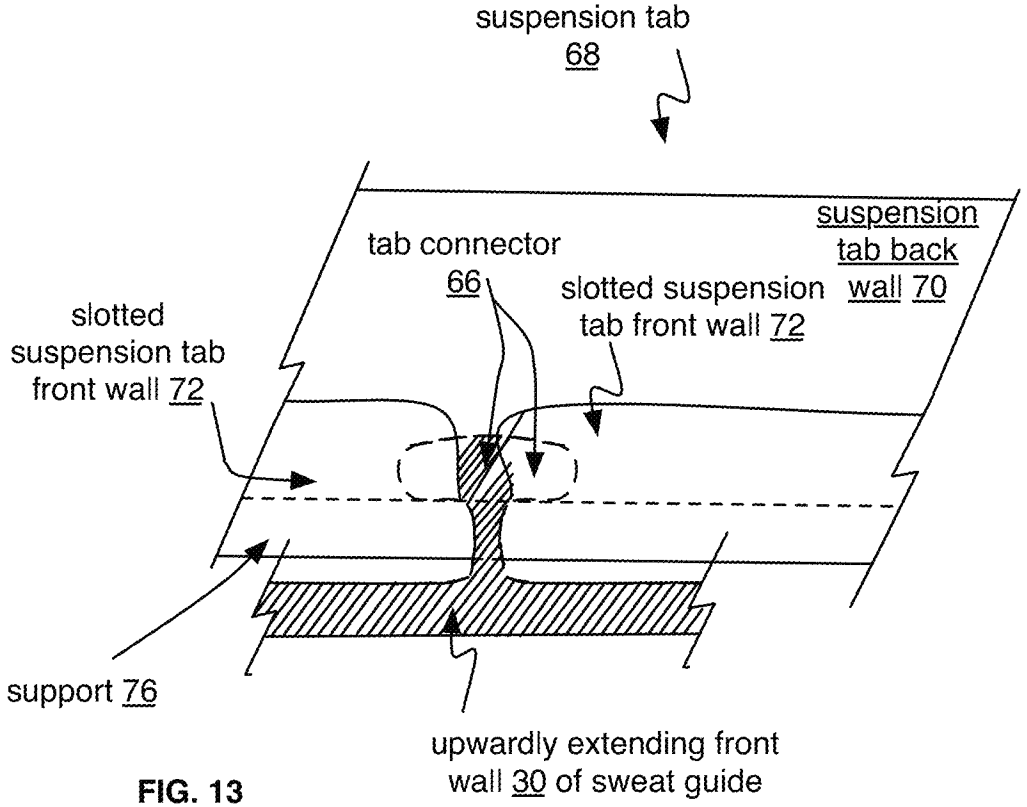
FIG. 13 is a front view of a suspension tab that is coupled to a tab connector.

FIG. 13 is a front view of a suspension tab that is coupled to a tab connector. As may be seen, suspension tab 68 includes a suspension tab back wall 70 and a slotted suspension tab front wall 72. The combination of the back wall 70 and the slotted front wall 72 form a connector port 74 (not labeled here) for receiving and engaging tab connector 66. A support 76 forms a base that securely holds or supports tab connector 66. FIG. 13 primarily illustrates the tab connector 66 engaged with suspension tab 68.

Figure 14:
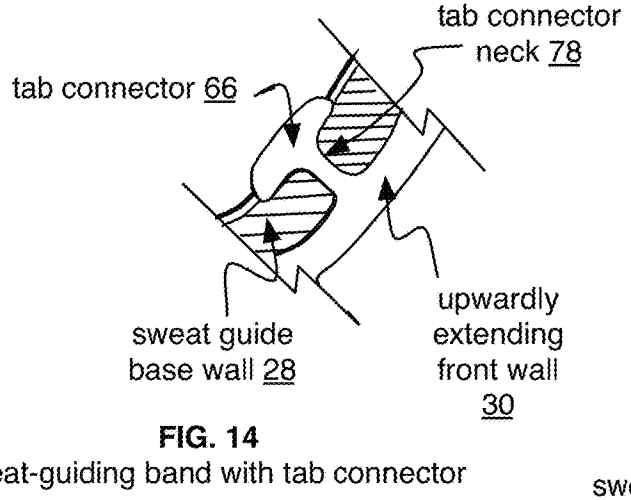
FIG. 14 is a perspective view that illustrates one embodiment in which tab connector 66 extends upwards from a front wall of a sweat-guiding band.

FIG. 14 is a perspective view that illustrates one embodiment in which tab connector 66 extends upwards from a front wall of a sweat-guiding band.

Figure 15:
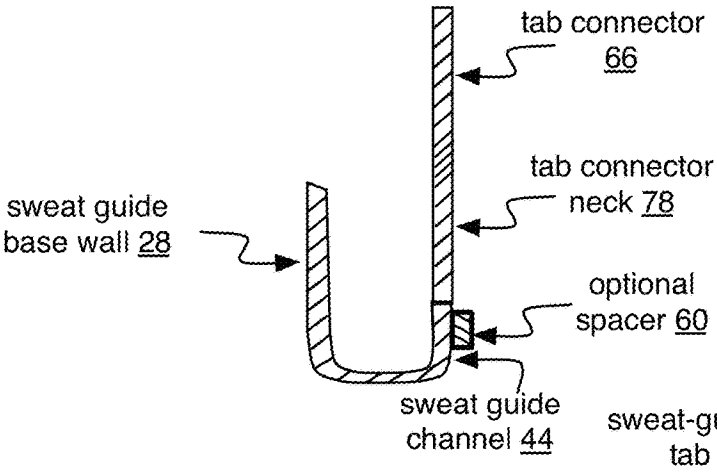
FIG. 15 is a side cutaway view of a sweat-guiding band with a tab connector and spacer according to one embodiment of the invention.

FIG. 15 is a side cutaway view of a sweat-guiding band with a tab connector and spacer according to one embodiment of the invention. This cutaway view is for a structure similar to that shown in FIG. 14 with the addition of optional spacer 60 to support ventilation between a user's forehead and a cap front panel.

Figure 16:
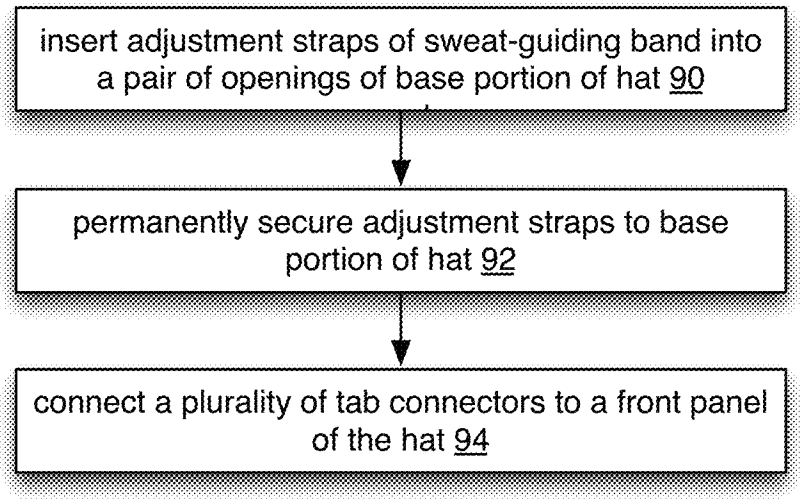
FIG. 16 is a flow chart illustrating a method for assembling a hat according to one embodiment of the invention.

FIG. 16 is a flow chart illustrating a method for assembling a hat according to one embodiment of the invention. The method includes inserting adjustment straps of a sweat-guiding band into a pair of openings of base portion of hat (90). FIGS. 1-3 illustrate embodiments of a hat base 04 with openings through which either the adjustment straps or sweat-guiding band can be threaded to insert into the hat base 04. Alternatively, the method can include laying the adjustment straps and sweat-guiding band within the base 04 prior to base 04 being stitched or sewn together during assembly of the hat. The method also includes permanently securing adjustment straps and the sweat channel guide to a base portion of the hat (92). As described before, this step can include sewing or stitching the straps, sweat-guiding band and hat (hat base) together. Finally, the method includes connecting a plurality of tab connectors to a front panel of the hat (94). Any of the embodiments for tab connectors and corresponding configurations within the hat and sweat-guiding band of the various figures may be implemented.

The specification makes references to terms such as approximately and substantially. The reader should understand that such terms are intended to show general relationships. Thus, for example, to surfaces that are substantially parallel may not be exactly parallel but, from an appearance perspective are parallel or nearly parallel. Such terms are used with the intent of explaining the essence of a relationship between two structural elements. While the invention is susceptible to various modifications and alternative forms, specific embodiments thereof have been shown by way of example in the drawings and detailed description. It should be understood, however, that the drawings and detailed description thereto are not intended to limit the invention to the particular form disclosed, but, on the contrary, the invention is to cover all modifications, equivalents and alternatives falling within the spirit and scope of the present invention as defined by the claims. Each of the figures herein illustrate various aspects of the various embodiments of the invention. Permutations of the shown embodiments made by combining aspects illustrated within the various drawings are considered to be within the scope and teachings of this invention. As may be seen, therefore, the described embodiments may be modified in many different ways without departing from the scope or teachings of the invention.

The invention claimed is:

1. A hat configured to drain away sweat from a user's eyes, comprising:

a non-absorbent sweat-guiding band that defines a channel configured for guiding sweat away from the user's eyes when being worn by a user, the sweat-guiding band further comprising:

a base wall configured to rest against the user's forehead;

an upwardly extending containment wall that extends upward from the channel roughly parallel to the base wall; and a plurality of tabs that extend upwardly from either one of the containment wall and or the base wall;

a front panel;

at least one reinforced member formed integral to the front panel that defines at least one attachment point configured to connect to at least one of the plurality of tabs;

a pair of adjustment straps permanently attached to the hat and to the sweat-guiding band;

wherein the sweat-guiding band is integral with portions of the hat such that there are a first plurality of segments of the sweat-guiding band that are completely surrounded by the hat and disposed between layers of material of the hat and not visible and a second plurality of segments of the sweat-guiding band extend through openings in the hat material and are exposed and contact the user when being worn;

wherein the hat includes an inner surface configured to selectively contact the user's head, the inner surface being behind the sweat-guiding band when the second plurality of segments of the sweat-guiding band extends through the openings in the hat; and wherein the sweat-guiding band and hat are jointly configured to cooperatively support the hat and configured to hold the hat off of the user's forehead while resting on the user's head elsewhere and further wherein the front panel of the hat is attached to an outer portion of the sweat-guiding band so as to be configured to be held in place away from the user's forehead by the sweat-guiding band to allow air to circulate between the user's forehead and the front panel.

2. The hat of claim 1, the front panel of the hat further comprising buttonholes for receiving tab connectors that extend from the tabs of the sweat-guiding band.

3. The hat of claim 2, wherein the tab connectors extend substantially horizontally from the tabs of the sweat-guiding band.

4. The hat of claim 1, wherein the tabs are formed integral to the upwardly extending containment wall of the sweat-guiding band.

5. An integrated sweat-guiding band and hat, comprising:

a sweat-guiding band having a sweat-guiding portion and an adjustment portion, wherein the sweat-guiding band further comprising a base wall and an upwardly extending containment wall defining a channel for conducting sweat away from a user's eyes, the sweat-guiding portion having a plurality of upwardly extending tabs;

adjustment straps permanently attached to the sweat-guiding band, the adjustment straps including means for adjustably securing the sweat-guiding band to a user's head;

wherein the hat is a cap or visor and the sweat-guiding band is integrally formed to the cap or visor;

wherein a front panel of the cap or visor is configured to couple to the upwardly extending tabs to attach the cap or visor to the sweat-guiding band;

the tabs are configured to be connected to the front panel in a manner that holds the front panel away from a user's forehead and eyes;

the sweat-guiding band is integral with portions of the hat such that there are a first plurality of segments of the sweat-guiding band that are completely surrounded by the hat and disposed between layers of material of the hat and not visible and a second plurality of segments of the sweat-guiding band extend through openings in the hat material and are exposed and contact the user when being worn; and wherein the hat includes an inner surface configured to selectively contact the user's head, the inner surface being behind the sweat-guiding band when the second plurality of segments of the sweat-guiding band extends through the openings in the hat.

6. The integrated sweat-guiding band and hat of claim 5, wherein the cap or visor is permanently attached to the adjustment straps approximate to where the adjustment straps are permanently attached to the sweat-guiding band.

7. The integrated sweat-guiding band and hat of claim 5, wherein the cap or visor defines a plurality of openings and is configured to receive at least one of the attachment straps and the sweat-guiding band prior to the cap or visor being permanently attached to the adjustment straps.

8. The integrated sweat-guiding band and hat of claim 5, wherein the adjustment straps comprise hook and loop fastener configured for adjustably securing the sweat-guiding band to a user's head.

9. The integrated sweat-guiding band and hat of claim 5, wherein the adjustment straps comprise one of tabbed connectors or a buckle configured for adjustably securing the sweat-guiding band to a user's head.

10. The integrated sweat-guiding band and hat of claim 5, wherein the tab connectors extend upwards from the upwardly extending containment wall of the sweat-guiding band.

11. A hat configured to drain away sweat from a user's eyes, comprising:

a non-absorbent sweat-guiding band that defines a channel configured for guiding sweat away from the user's eyes and forehead, the sweat-guiding band further comprising: a base wall that is configured to rest against the user's forehead; an upwardly extending containment wall that extends upward from the channel roughly parallel to the base wall; and at least one tab that extends upwardly from either one of the containment wall and the base wall;

a hat front panel;

a pair of adjustment straps permanently attached to the hat and to the sweat-guiding band;

wherein the at least one tab is attached to the hat front panel;

the sweat-guiding band and the hat are jointly configured to cooperatively support the hat and configured to hold the hat off of the user's forehead while resting on the user's head elsewhere to allow air to circulate between the user's forehead and the hat front panel and further wherein the front panel of the hat is attached to an outer portion of the sweat-guiding band so as to be held in place away from the user's forehead by the sweat-guiding band to allow air to circulate between the user's forehead and the front panel;

wherein the sweat-guiding band is integral with portions of the hat such that there are a first plurality of segments of the sweat-guiding band that are completely surrounded by the hat and disposed between layers of material of the hat and not visible and a second plurality of segments of the sweat-guiding band extend through openings in the hat material and are exposed and contact the user when being worn; and wherein the hat includes an inner surface configured to selectively contact the user's head, the inner surface being behind the sweat-guiding band when the second plurality of segments of the sweat-guiding band extends through the openings in the hat.

12. The hat of claim 11, wherein each tab of the at least one tab is formed integral to the upwardly extending containment wall of the sweat-guiding band.

* * * * *